US005826569A

United States Patent [19]

Voorhis

[11] Patent Number: 5,826,569

[45] Date of Patent: Oct. 27, 1998

[54] LOW $NO_X$ WATER HEATER WITH FINNED BURNER

[75] Inventor: Daniel Voorhis, Gray, Tenn.

[73] Assignee: American Water Heater Company, Johnson City, Tenn.

[21] Appl. No.: 725,771

[22] Filed: Oct. 4, 1996

[51] Int. Cl.[6] ..... F24H 1/00

[52] U.S. Cl. ..... 126/361; 431/177; 431/171; 122/14; 239/128

[58] Field of Search ..... 431/177, 171, 431/172, 350; 126/361; 122/16, 17, 13.1, 14; 239/128, 132.3

[56] References Cited

U.S. PATENT DOCUMENTS

| | | | |
|---|---|---|---|
| 1,583,362 | 5/1926 | Ostendorf | 431/350 |
| 1,699,032 | 1/1929 | Shuell et al. | 431/172 |
| 1,933,790 | 11/1933 | Crone | 431/172 |
| 2,201,678 | 5/1940 | Dufault | 239/128 |
| 2,409,421 | 10/1946 | Dufault | 235/129 |
| 2,642,127 | 6/1953 | Sievert | 122/17 |
| 2,840,152 | 6/1958 | Reed | 431/350 |
| 2,851,092 | 9/1958 | McKee | 431/172 |
| 4,493,638 | 1/1985 | Scammell | 431/171 |
| 5,335,646 | 8/1994 | Katchka | 122/17 |

*Primary Examiner*—Carroll B. Dority
*Attorney, Agent, or Firm*—Lee, Mann, Smith, McWilliams, Sweeney & Ohlson

[57] ABSTRACT

A low $NO_x$ water heater burner including a burner body having opposed surfaces; and a multiplicity of spaced apart energy absorbing fins connected to at least one of the surfaces and positioned to absorb energy from burner flames generated by combustion of fuel, wherein flames generated by combustion of fuel proximate said fins are positioned such that the fins absorb energy from the flames, thereby lowering flame temperature and reducing $NO_x$ emissions.

21 Claims, 5 Drawing Sheets

LOW $NO_X$ WATER HEATER WITH FINNED BURNER

FIELD OF THE INVENTION

The invention relates to an improved construction for a gas water heater and particularly to a gas water heater with a low $NO_x$ burner.

BACKGROUND OF THE INENTION

Water heaters are commonly employed in homes and small businesses to heat water for domestic use. Such water heaters are produced in large numbers and sold to consumers in a very competitive market. A large portion of these devices use gaseous fuel, such as natural or bottled gas as an energy source.

Conventional gas fired water heaters often include a water tank, a water inlet, a water outlet, a combustion chamber disposed below or within the tank, a gas regulator and a burner disposed within the combustion chamber. The structure is thermally insulated. Conventionally, the temperature of water within the tank is regulated. When the water temperature drops below a certain minimum, fuel flows to the burner within the combustion chamber where it is ignited, heating the combustion chamber and the body of water above or around the combustion chamber. The products of combustion are vented through a flue connected to the combustion chamber and typically passing through the water tank. Numerous variations upon this construction have been created in attempts to increase efficiency, reduce potentially polluting emissions and otherwise improve operating characteristics.

The efficiency of water heaters has become more important over the last several years. This is the result of government regulation and also heightened consumer awareness concerning consumption of natural resources. Additionally, concern for the environment has made the elimination of potentially polluting substances from the products of combustion more important. While gas fired water heaters are very low polluters when compared to many other fuel consuming products, there are many water heaters in use. Government bodies and consumers have, therefore, sought to further reduce the contribution of pollutants emanating from water heaters, especially $NO_x$ emissions.

In addition to the above important design criteria, cost is a very important factor in producing water heaters. Water heaters are mass produced and sold throughout a large marketplace. In the United States, national companies compete very aggressively for sales. Water heaters must, therefore, be very economically manufactured or they will not sell well and consumers will not gain the benefits of design improvements.

OBJECT OF THE INVENTION

An object of the invention is to provide a water heater having improved operating characteristics which is inexpensive to manufacture on a production basis.

It is another object of the invention to provide a water heater which has reduced emissions of oxides of nitrogen.

It is still another object of the invention to provide a water heater having both improved efficiency while the water heater is operating and improved efficiency overall, such as low operating and standby losses.

It is still another object of the invention to provide a water heater having a burner that may be used in connection with existing combustion chambers of different sizes, shapes and constructions.

Other objects and advantages to the invention will appear from the following detailed description thereof and from the accompanying drawings.

SUMMARY OF THE INVENTION

The invention contemplates a new and improved water heater construction which overcomes the above problems and others and provides a water heater which is economical to manufacture, economical to operate, burns fuel cleanly and answers governmental regulations.

In accordance with a principal aspect of the invention, a water heater is provided having a tank adapted to contain a body of water and a finned burner assembly positioned adjacent the tank. Still further in accordance with the invention, a skirt generally matching the outside diameter of the tank is positioned below the tank. A bottom pan is fixed to the skirt around its bottom, thereby forming a combustion chamber. The finned burner is positioned within the combustion chamber to provide for low emissions of $NO_x$.

The finned burner is formed from a substantially circular base plate having a multiplicity of passageways spaced around but positioned inwardly of the outer edge of the plate. A multiplicity of fins, preferably circularly shaped, are fixed along the outer edge of the plate at the end of the passageways and positioned substantially perpendicularly with respect to the plate. A cup shaped base member is positioned below the plate and has a multiplicity of holes in its side wall to receive a limited amount of combustion air and at least one hole sized to connect to a fuel supply conduit.

DETAILED DESCRIPTION OF THE INVENTION

Figure 1:
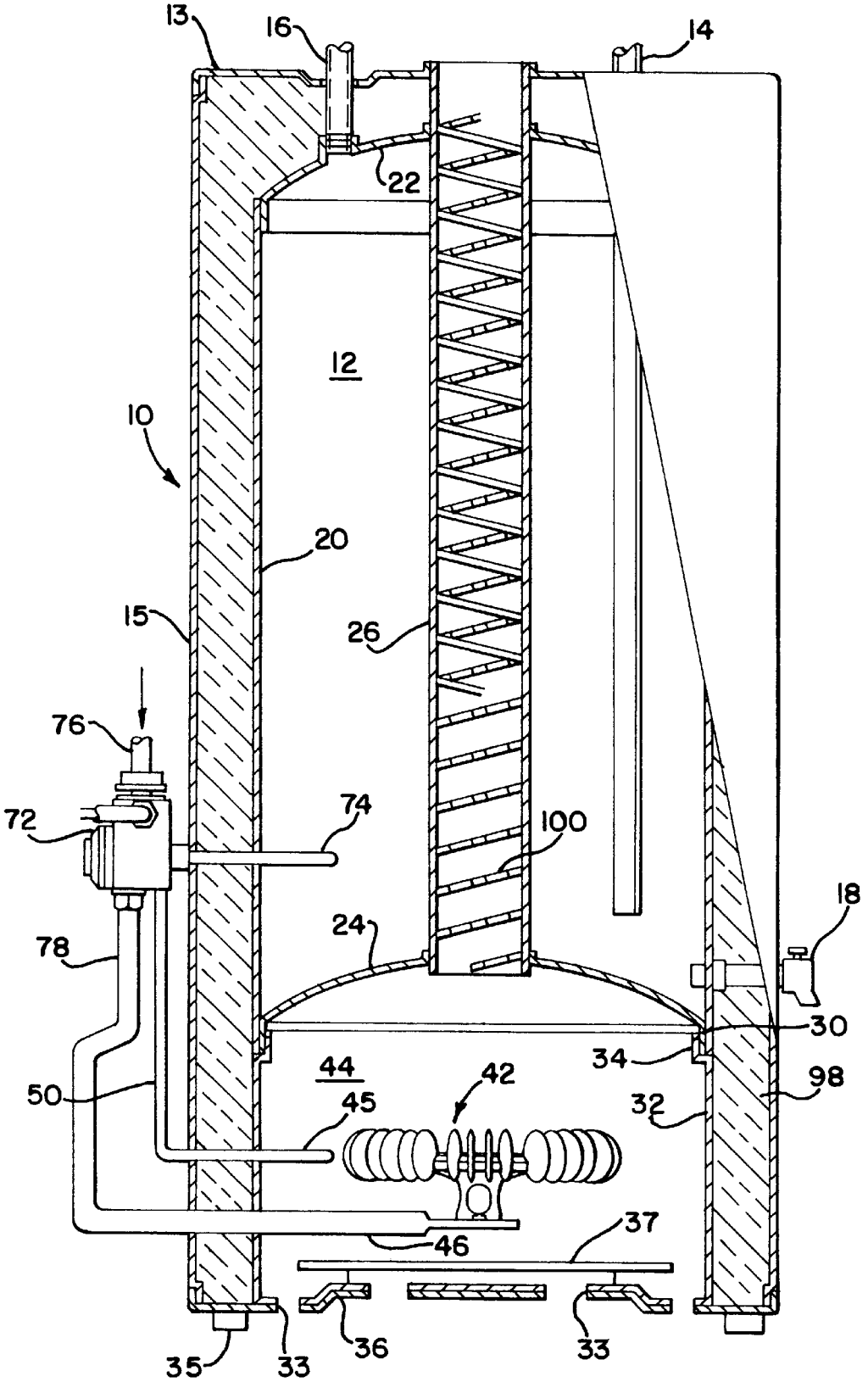
FIG. 1 is a side elevational view of a water heater in accordance with the invention, mostly cut-away to the center line of the flue.
Figure 2:
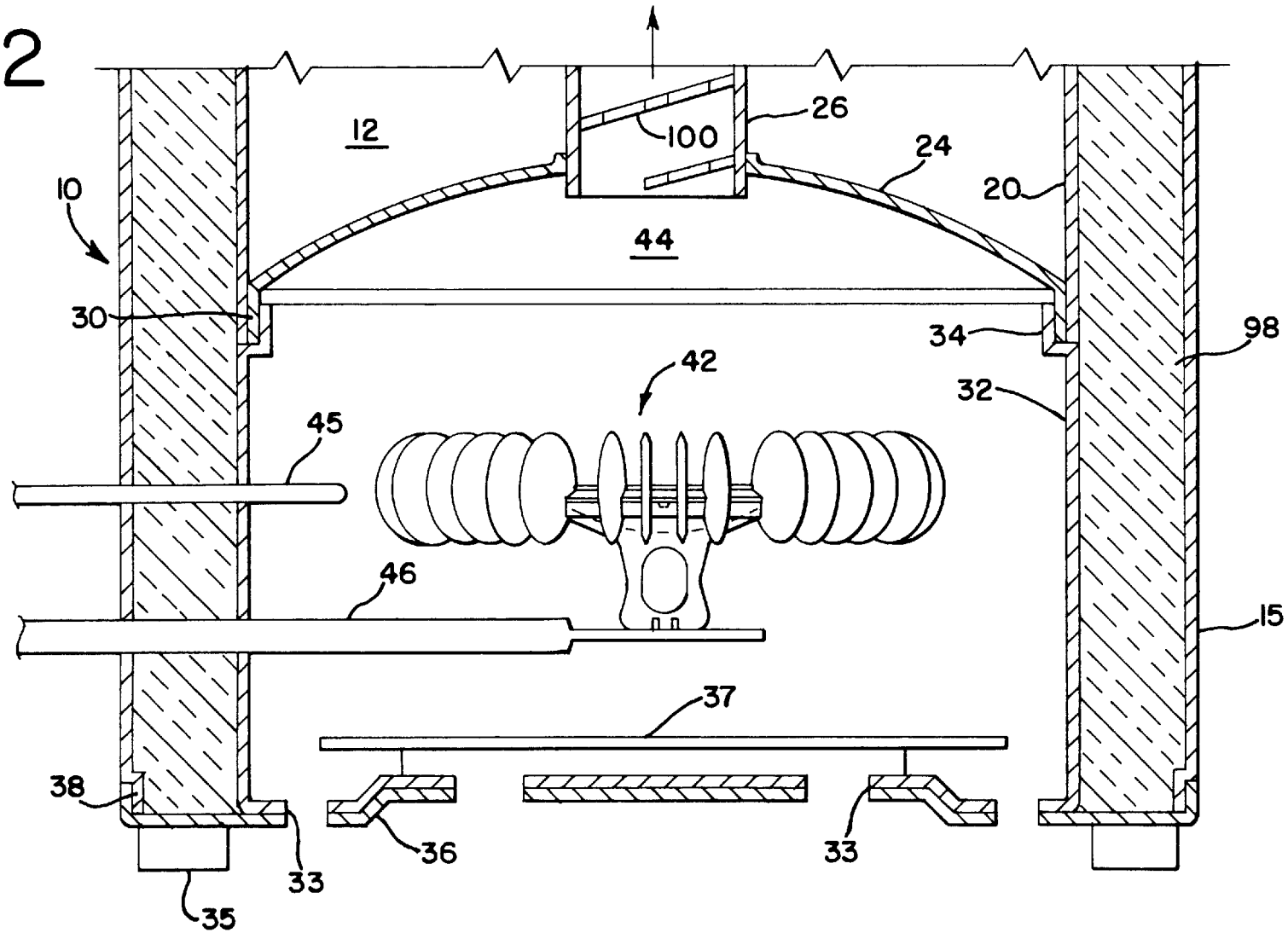
FIG. 2 is an enlarged detail drawing of the combustion chamber burner area of the water heater shown in FIG. 1.
Figure 3:
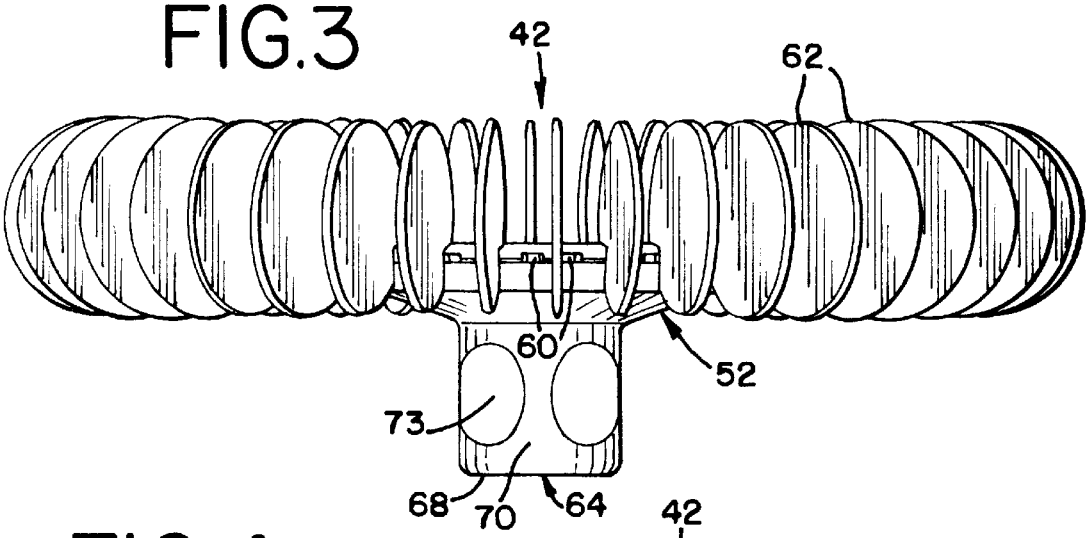
FIG. 3 is an enlarged front elevational view of the burner shown in FIGS. 1 and 2.
Figure 4:
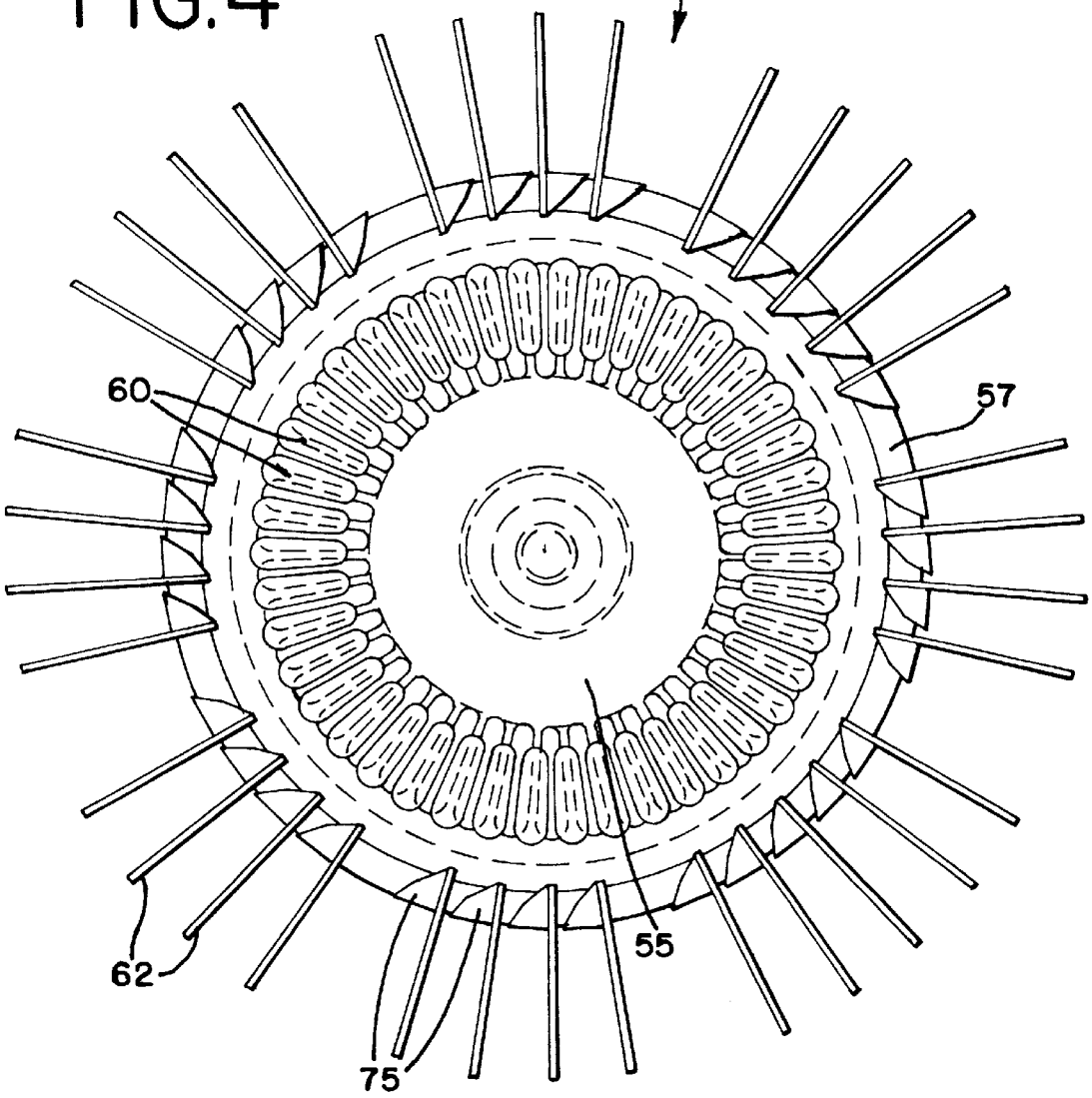
FIG. 4 is a top plan view of the burner shown in FIG. 3.
Figure 5:
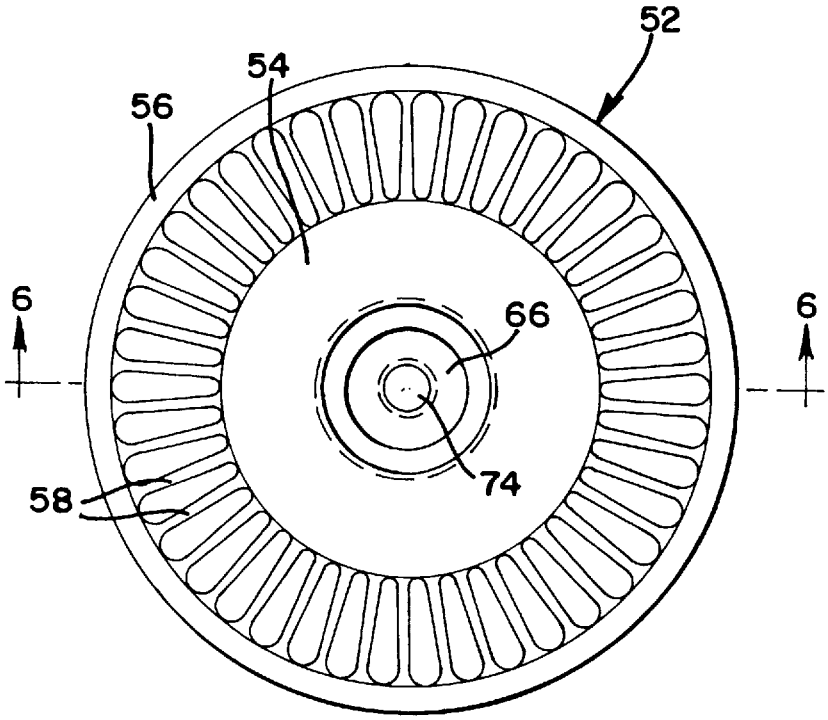
FIG. 5 is a top plan view of a lower portion of the burner shown in FIG. 3.
Figure 6:
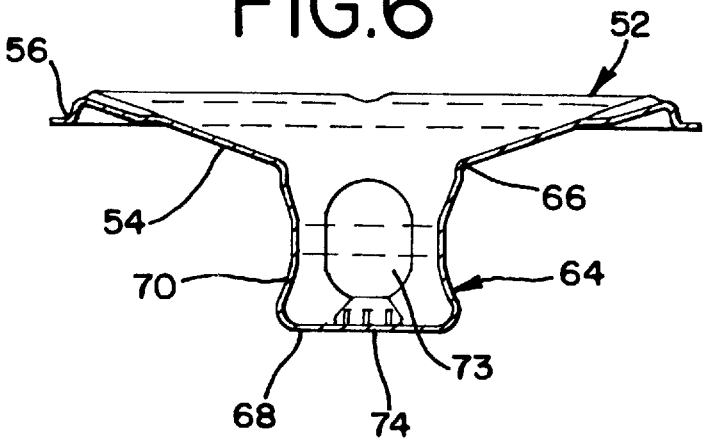
FIG. 6 is a side view of the lower portion of the burner shown in FIG. 3 and taken along the lines VI—VI.
Figure 7:
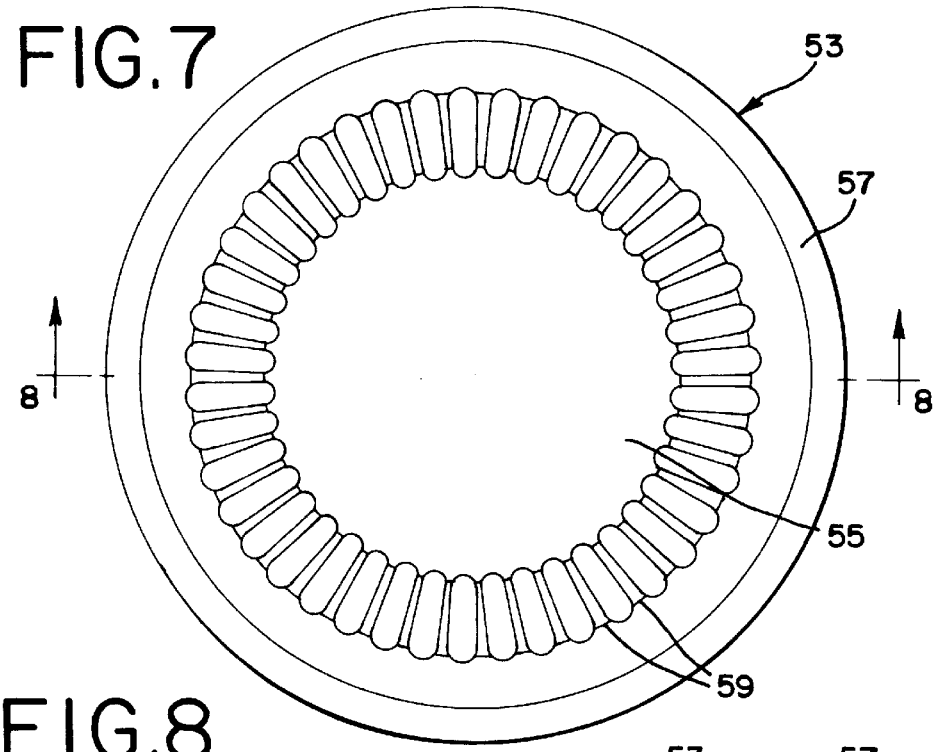
FIG. 7 is a top plan view of an upper portion of the burner shown in FIG. 3.
Figure 8:
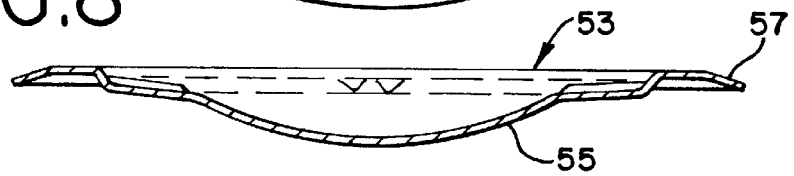
FIG. 8 is a side view of the upper portion of the burner shown in FIG. 3 and taken along the lines VIII—VIII.

Referring now to the drawings wherein the structures shown are for the purposes of illustrating the selected embodiments of the invention and not for the purposes of limiting same, the figures in general and FIGS. 1 and 2 in particular, show a water heater 10 comprising a tank 12 adapted to contain water and having an inlet 14 and an outlet 16. Water heater 10 also comprises insulation 98 surrounding tank 12 and extending between top pan 13 and bottom pan 36 and outer jacket 15. A drain 18 is also provided as is conventional. Tank 12 has a cylindrical side wall 20, a dome-shaped top 22, water tightly fixed to the side wall 20 and a bottom wall 24. A cylindrical flue 26 passes through the center of tank 12 and communicates with the space below bottom wall 24. Flue 26 has baffles 100 which conduct products of combustion away from the water heater in a manner to increase heat transfer to water in tank 12.

Bottom wall 24 is provided with a downwardly extending cylindrical flange 30 around its entire periphery. This flange 30 is fixed to tank side wall 20 by means of welding or the like. A cylindrical skirt 32 is positioned below tank 12. Skirt 32 is preferably provided with either a reduced portion 34 (shown) or an enlarged portion (not shown) which engages the bottom of tank 12. In the embodiment shown, reduced portion 34 is fixed to the inside surface of flange 30 of bottom wall 24. Welding or the like, when used, may provide a permanent gas tight joint between reduced portion 34 and flange 30.

A bottom pan 36 connects to a flange 38 of jacket 15 to form the base of water heater 10. Bottom pan 36 rests on feet 35 and has openings 33 for ingress of combustion air. Skirt 32 extends downwardly into contact with bottom pan 36. Skirt 32, bottom pan 36 and bottom wall 24 form a combustion chamber 44. A reflecting pan or radiation shield 37 may preferably be added to combustion chamber 44 just above or resting upon bottom pan 36. Such reflecting pans are conventional and well known to those of ordinary skill in the art. Further, insulation (not shown) may be placed under the reflecting pan to provide additional insulative characteristics to the water heater.

A finned burner 42 is located within combustion chamber 44. Burner 42 connects to a fuel manifold 46 which extends outwardly from combustion chamber 44, through skirt 32, insulation 98 and outer jacket 15 and connects to gas line 78. Manifold 46 may be suspended above bottom pan 36 in any manner conventionally known in the art.

A controller 72 is located outwardly of the water heater and senses the temperature of the body of water contained in tank 12 by means of a sensor 74. Controller 72 receives gas through a supply line 76 and provides gas through a gas line 78 to manifold 46. Controller 72 also controls the operation of igniter 45 located in combustion chamber 44. When sensor 74 senses low water temperature, thermostat 72 provides gas to manifold 46.

Referring now to FIGS. 3–8, the finned burner 42 is shown in detail. Burner 42 includes lower plate 52 which is substantially circular and most preferably consists of an inner sloped portion 54 and an outer sloped portion 56, the direction of slope being in opposed directions. The angle of slope for the portions 54 and 56 is not particularly critical. It is, however, highly preferred that the slopes are in different directions. The presence of outer sloped portion 56 is not essential but is highly preferred. Inner sloped portion 54 has a series of raised ribs 58 which extend radially outwardly and terminate substantially at outer sloped portion 56. Raised ribs 58 do not need to extend over the entire surface of inner sloped portions 54.

Lower plate 52 is integral with a burner base 64 and includes an open end 66, a closed end 68 and a substantially tubular-shaped side wall 70. Open end 66 connects directly to and is integral with inner sloped portion 54 such as by deep drawing or the like. Side wall 70 has a plurality of openings 73. Similarly, closed end 68 has an opening 74. Opening 74 connects to manifold 46 directly or by way of a conduit (not shown) to supply fuel into the interior of base member 64.

Burner 42 also includes upper plate 53 which is substantially circular and consists of an inner sloped portion 55, which forms a bowl shape, and an outer sloped portion 57. The angle of slope for the portions 55 and 57 is not particularly critical. It is preferred that the slopes are in different directions. As with lower plate 52, it is not essential to have outer sloped portion 57, but it is highly preferred. Inner sloped portion 55 has a series of ribs 59 that extend radially outwardly and terminate substantially at outer sloped portion 57. Ribs 59 need not extend over the entire surface of inner sloped portion 57.

Outer sloped portion 57 has a multiplicity of fins 62 connected in a substantially even spaced apart manner. Each fin is permanently connected to sloped outer portion 56 such as by welding or the like. Each fin 62 is capable of absorbing energy from burner flames and is preferably metallic. Each fin extends both above and below opposed plates 52 and 53, although it is not necessary that they do so. The fins are oriented substantially perpendicular with respect to the general orientation of plate 52, although it is possible that orientations other than perpendicular such as 5°, 10°, 15° or more are possible.

Upper and lower plates 53 and 52 connect together, such as by welding for example, such that inner sloped portions 54 and 55 and outer sloped portions 56 and 57 are substantially concentrically aligned. Also, ribs 58 and 59 are aligned to form passageways 60 for the flow of fuel and combustion air.

Figure 9A:
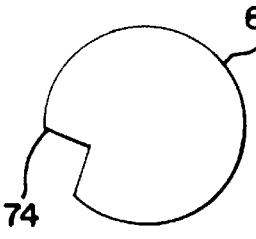
FIGS. 9A–G are front elevational views of preferred burner fins.
Figure 9B:
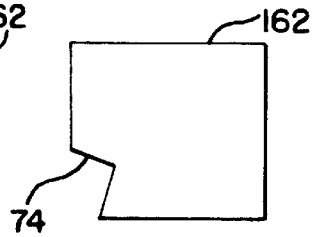
Figure 9C:
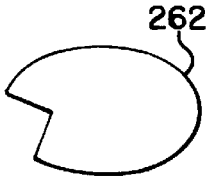
Figure 9D:
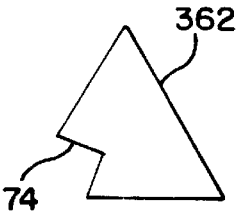
Figure 9E:
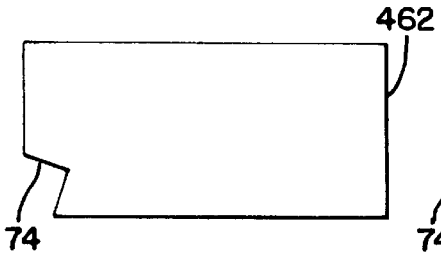
Figure 9F:
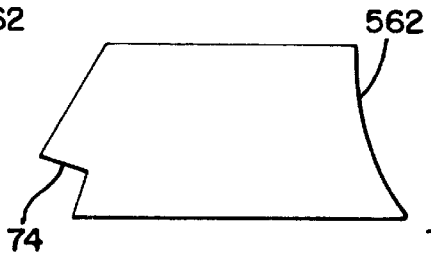
Figure 9G:
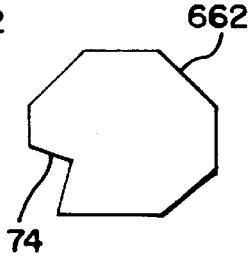

FIGS. 9A–G show preferred shapes of fins 62, 162, 262, 362, 462, 562 and 662, respectively. Fin 62 in FIG. 9A is substantially round, fin 162 in FIG. 9B is substantially square, fine 262 in FIG. 9C is substantially oval, fin 362 in FIG. 9D is substantially triangular, fin 462 in FIG. 9E is substantially rectangular, fin 562 in FIG. 9F is substantially trapezoidal, and fin 662 in FIG. 9G is substantially octagonal. Other shapes such as parallelograms and the like are also possible. Each fin has a slot 74 to facilitate connection with outer sloped portion 56. The slot 74 is formed by cutting the fins along a line that allows a tab 75 (shown in FIG. 4) to engage outer sloped portion 56. Tabs 75 are preferably welded into position.

As can be seen in FIG. 1, the operation of water heater 10, which is apparent to the end user, is much the same as the operation of conventional water heaters. When hot water is required, controller 72 provides gas to manifold 46 and finned burner 42 which burns within combustion chamber 44. When the water in tank 12 is heated to a desired temperature, controller 72 interrupts the flow of gas and combustion ceases. Because hot water is contained within tank 12, a draft through water heater 10 may be maintained and the air and fuel mixture contained within combustion chamber 44 is drawn up through passageways 60 to be combusted prior to the extinguishing of combustion on the top surface of upper plate 53.

In particular, fuel is supplied to finned burner 42 by way of fuel supply line 78 and manifold 46. Fuel flows from manifold 46 into base member 64 through opening 74 and exits outwardly of base member 64 through opening 66. Combustion air enters combustion chamber 44 through openings 33 and travels past radiation shield 37. A portion of the air proceeds toward fins 62 to mix with fuel in the vicinity of the exit ends of gas ports 60. Another portion passes through openings 73 and mixes with fuel traveling toward gas ports 60. Because the gaseous fuel is pressurized, it migrates upwardly into contact with the under surface of inner sloped portion 55 of upper plate 53 and then migrates radially outwardly through gas ports 60 toward outward sloped portion 57. The gaseous fuel then proceeds past inner sloped portions 54 and 55 and then past outer sloped portions 56 and 57 and is ignited by igniter 45 (FIGS. 1 and 2). Flames project upwardly and somewhat radially outwardly toward fins 62 whereby energy from the flames is absorbed by fins 62. This lowers the temperature of the flames, which results in lowering of $NO_x$ emissions.

Combustion air is preferably provided through openings 33 in base pan 36 although it may be provided from a number of sources, depending on the type and intended use of water heater 10. For example, combustion air can be supplied by way of an outer door (not shown) or combustion air can be supplied through a conduit (not shown) extending to the exterior of water heater 10 and in many cases to the exterior of the building in which water heater 10 is located. Similarly, the construction of combustion chamber 44 can be such that ambient air is capable of penetrating through joints in the base of water heater 10 in a quantity sufficient to supply combustion air.

EXAMPLES

Nine conventional water heaters, having conventional burners, manufactured by the assignee herein were tested for $NO_x$ emissions (in PPM) and their relative $NO_x$ emissions on a Ng/J basis was calculated and set as a base line. The water heaters were then retrofitted with burners of the invention and the same tests were run.

Table 1 shows test results from the nine water heaters utilized in accordance with the invention. Such water heaters achieved a 44% decrease in $NO_x$ emissions over the conventional produced water heaters.

TABLE 1

| Ex. | Water Heater Model | Ambient TEMP (DEG. F.) | Gas Consumed (Vol. Cu. Ft.) | Gas Temp (DEG. F.) | Heating Vaue (BTU/CU. FT) | $H_2O$ TEMP OUT (DEG. F.) | $H_2O$ TEMP IN (DEG. F.) |
|---|---|---|---|---|---|---|---|
| 1 | MHG30T3 | 69 | 7.53 | 70 | 1046 | 142 | 70 |
| 2 | MHG40T3 | 69 | 7.47 | 70 | 1033 | 140 | 71 |
| 3 | 29S35 | 68 | 9.23 | 65 | 1018 | 141.35 | 70.1 |
| 4 | 50T50 | 69 | 7.03 | 76 | 1045 | 138.5 | 70.4 |
| 5 | 40T40 | 72 | 6.24 | 76 | 1053 | 143 | 76.1 |
| 6 | 40S40 | 68 | 6.14 | 76 | 1053 | 137.9 | 76 |
| 7 | 30S30 | 68 | 9.49 | 66 | 1007 | 142.29 | 73.8 |
| 8 | 19T28 | 69 | 7.40 | 70 | 1050 | 142.1 | 74 |
| 9 | 50T38 | 70 | 7.40 | 70 | 1035 | 140.1 | 74.4 |

| Ex. | MAX $H_2O$ TEMP (DEG. F.) | OUT-PUT (BTU) | $CO_2$ (PPM) | $NO_x$ (PPM) | CO (PPM) | $NO_x$ BASE LINE (Ng/J) | TEST DATA (Ng/J) |
|---|---|---|---|---|---|---|---|
| 1 | 140.3 | 6539 | 3.8 | 22.12 | 3.6 | 78.7 | 37 |
| 2 | 139.1 | 5746 | 3.63 | 24.6 | 0 | 65.9 | 47.7 |
| 3 | 141.45 | 6506.73 | 5 | 26 | 30 | 72 | 37.93 |
| 4 | 139.4 | 6375 | 3.63 | 19.6 | 80 | 67 | 32.50 |
| 5 | 139.8 | 5511 | 4.72 | 24.4 | 7.3 | 71 | 32.34 |
| 6 | 137.5 | 5042 | 4.7 | 24.37 | 1.50 | 73 | 35 |
| 7 | 141.45 | 6304.38 | 4.4 | 22.33 | 0 | 50 | 38.87 |
| 8 | 133 | 5761 | 4.30 | 21.0 | 2.2 | 63 | 34.6 |
| 9 | 139.2 | 7016 | 4.92 | 33.6 | 5.9 | 72.74 | 38.9 |

Operation of a water heater in accordance with the invention has several significant advantages. Efficiency is improved. Heat is primarily directed only to the water containing tank and is not directed to skirt 32 where it would be wasted. Foam of the type used as insulation for tank 12 can be used around the combustion chamber resulting in better insulation and better efficiency.

The invention has been described with reference to preferred embodiments. Modifications and alterations will occur to others upon the reading and understanding of this specification and it is my intention to include such modifications and alterations insofar as they come within the scope of the appended claims. For example, igniter 45 can be a traditional pilot light having a gas supply received from controller 72 or an electronic or electrical type device receiving power from controller 72. Also, upper and lower plates 53 and 52 may be integrally formed to form passageways 60 or other structures besides ribs 57 and 58 may be employed to form passageways 60. It is further possible that fins 62 are not spaced precisely evenly, although placement should be symmetric to provide balanced heating.

It is still further possible for water tank 12 to be of any number of sizes and shapes and made from a wide variety of materials. Also, combustion chamber 44 may have multiple sizes and shapes and may be in a number of positions adjacent to or contained within water tank 12. Flue 26 may have any number of shapes, sizes and travel paths within or alongside all or portions of water tank 12.

What is claimed is:

1. A low $No_x$ water heater burner comprising:

a burner body having opposed upper and lower surfaces forming a fuel chamber, said burner body including a plurality of burner ports about its periphery, a multiplicity of spaced apart substantially vertical energy absorbing fins connected substantially vertical to at least one of said surfaces and extending outward of the periphery of said burner body, said burner ports each having an axis and said fins being located adjacent opposite sides of said burner ports, substantially parallel to the axis of a burner port and extending outwardly of a burner port to absorb energy directly from the burner flames to lower flame temperature without restricting air flow, thereby reducing $No_x$ emissions.

2. The burner assembly as defined in claim 1 wherein said burner body is substantially circular.

3. The burner assembly as defined in claim 1 wherein said burner body is formed from upper and lower plates, each plate having an inner sloped portion and an outer portion sloped in another direction.

4. The burner assembly as defined in claim 3 wherein each of said inner sloped portions has a multiplicity of spaced apart ribs extending radially outwardly and said ribs are aligned to form passageways in said burner body for the passage of fuel toward said fins.

5. The burner assembly as defined in claim 1 wherein said fins are metallic.

6. The burner assembly as defined in claim 1 wherein said fins are substantially round.

7. The burner assembly as defined in claim 1 wherein shapes of said fins are selected from the group consisting of substantially rectangular, substantially oval, substantially triangular, substantially square, substantially trapezoidal and substantially octagonal.

8. The burner assembly as defined in claim 1 wherein said fins have slots sized and shaped to receive and connect to an outer edge portion of said burner body.

9. The burner assembly as defined in claim 3 wherein said fins are connected to said outer sloped portion of said upper plate.

10. The burner assembly as defined in claim 1 further comprising a base member positioned adjacent to a lower one of said surfaces and adapted to receive said fuel from a fuel supply and disperse said fuel toward said fins.

11. The burner assembly as defined in claim 10 wherein said base member comprises a substantially tubular side wall having an open end connected to one of said lower surface and a closed end, said closed end having an opening sized to receive said fuel, and said side wall having a plurality of openings to permit combustion air to mix with said fuel.

12. The burner assembly as defined in claim 1 wherein said fins are oriented substantially perpendicular to said burner body.

13. A low $NO_x$ water heater burner comprising:

a substantially circular plate with an outer edge portion and having a multiplicity of passageways positioned inwardly of said outer edge portion to receive fuel for combustion; and a multiplicity of spaced apart energy absorbing fins connected to said outer edge portion and oriented substantially perpendicularly with respect to said plate, said fins being positioned relative to said passageways such that at least a portion of combustion of said fuel occurs between adjacent fins to absorb energy from flames generated by combustion of said fuel passing through and outwardly of said passageways.

14. The burner assembly defined in claim 13 further comprising a base member positioned adjacent an under surface of said plate and adapted to receive fuel from a fuel supply and disperse said fuel toward said passageways.

15. The burner assembly defined in claim 13 wherein said burner body has an inner sloped portion and an outer portion sloped in another direction.

16. The burner assembly defined in claim 15 wherein said passageways terminate in a multiplicity of spaced apart openings that are substantially aligned with spaces between adjacent fins.

17. The burner assembly defined in claim 13 wherein said fins are metallic.

18. The burner assembly defined in claim 13 wherein said fins are substantially round.

19. The burner assembly defined in claim 13 wherein shapes of said fins are selected from the group consisting of substantially rectangular, substantially oval, substantially triangular, substantially square, substantially trapezoidal and substantially octagonal.

20. A water heater comprising:

a water tank having an inlet and an outlet;

a combustion chamber positioned adjacent to or at least partially within said tank; and a burner positioned within said combustion chamber, said burner including a burner body having opposed upper and lower surfaces forming a fuel chamber, said burner body including a plurality of burner ports about its periphery, a multiplicity of spaced apart energy absorbing fins connected substantially perpendicular to at least one of said surfaces and extending outward of the periphery of said burner body, said burner ports each having an axis and said fins being located adjacent opposite sides of said burner each having an axis and said fins being located adjacent opposite sides of said burner ports, substantially parallel to the axis of a burner port and extending outwardly of a burner port to absorb energy directly from the burner flames to thereby lower $No_x$ emissions.

21. A water heater comprising:

a water tank having an inlet and an outlet;

a combustion chamber positioned adjacent to or at least partially within said tank; and a burner positioned within said combustion chamber, said burner including a substantially circular plate with an outer edge portion and having a multiplicity of passageways positioned inwardly of said outer edge portion to receive fuel for combustion; and a multiplicity of spaced apart energy absorbing fins connected to said outer edge portion and oriented substantially perpendicularly with respect to said plate, said fins being positioned relative to said passageways such that at least a portion of combustion of said fuel occurs between adjacent fins to absorb energy from flames generated by combustion of said fuel passing through and outwardly of said passageways to thereby lower $NO_x$ emissions.

* * * * *